United States Patent [19]

Courtot

[11] 4,221,323

[45] Sep. 9, 1980

[54] CENTRIFUGAL FILTER WITH EXTERNAL SERVICE INDICATOR

[75] Inventor: Louis B. Courtot, Euclid, Ohio

[73] Assignee: The Glacier Metal Company Limited, Wembley, England

[21] Appl. No.: 967,242

[22] Filed: Dec. 7, 1978

[51] Int. Cl.[2] ..... B04B 9/06

[52] U.S. Cl. ..... 233/23 R; 233/1 R; 233/2

[58] Field of Search ..... 233/23 R, 24, 1 R, 1 B, 233/19 R, 2; 210/113

[56] References Cited

U.S. PATENT DOCUMENTS

| | | | |
|---|---|---|---|
| 3,784,092 | 1/1974 | Gibson | 233/23 R |
| 3,970,243 | 7/1976 | Hentschel | 233/19 R |
| 4,046,315 | 9/1977 | Klingenberg | 233/23 R |
| 4,106,689 | 8/1978 | Kozulla | 233/23 R |

FOREIGN PATENT DOCUMENTS

| | | | |
|---|---|---|---|
| 980746 | 12/1975 | Canada | 233/23 R |
| 2300622 | 10/1976 | France | 233/19 R |

*Primary Examiner*—George H. Krizmanich

*Attorney, Agent, or Firm*—Pearne, Gordon, Sessions

[57] ABSTRACT

A centrifugal separator for separating contaminants from contaminated oil is disclosed. The centrifugal separator has a shroud which defines a first chamber and has a hollow rotor mounted for rotation therewith in the first chamber and defining a second chamber. Oil under pressure is admitted to the second chamber through a rotatable, hollow spindle on which the rotor is fixed. The oil flows into the first chamber through tangential reaction nozzles in the rotor to cause contaminants to migrate toward the sidewall of the second chamber under the influence of centrifugal force. The spindle is axially movable in the shroud, and is biased toward the upper end of the shroud by a spring. An indicator pin extends through the top of the shroud and is biased against the top of the spindle so that it follows movements of the spindle. As the contaminants build up on the sidewalls of the rotor, the spindle, and therefore the indicator pin, move downwardly so that an inspection of the indicator pin will inform the observer as to the build up of contaminants within the rotor without disassembling the separator.

4 Claims, 3 Drawing Figures

Fig. 1
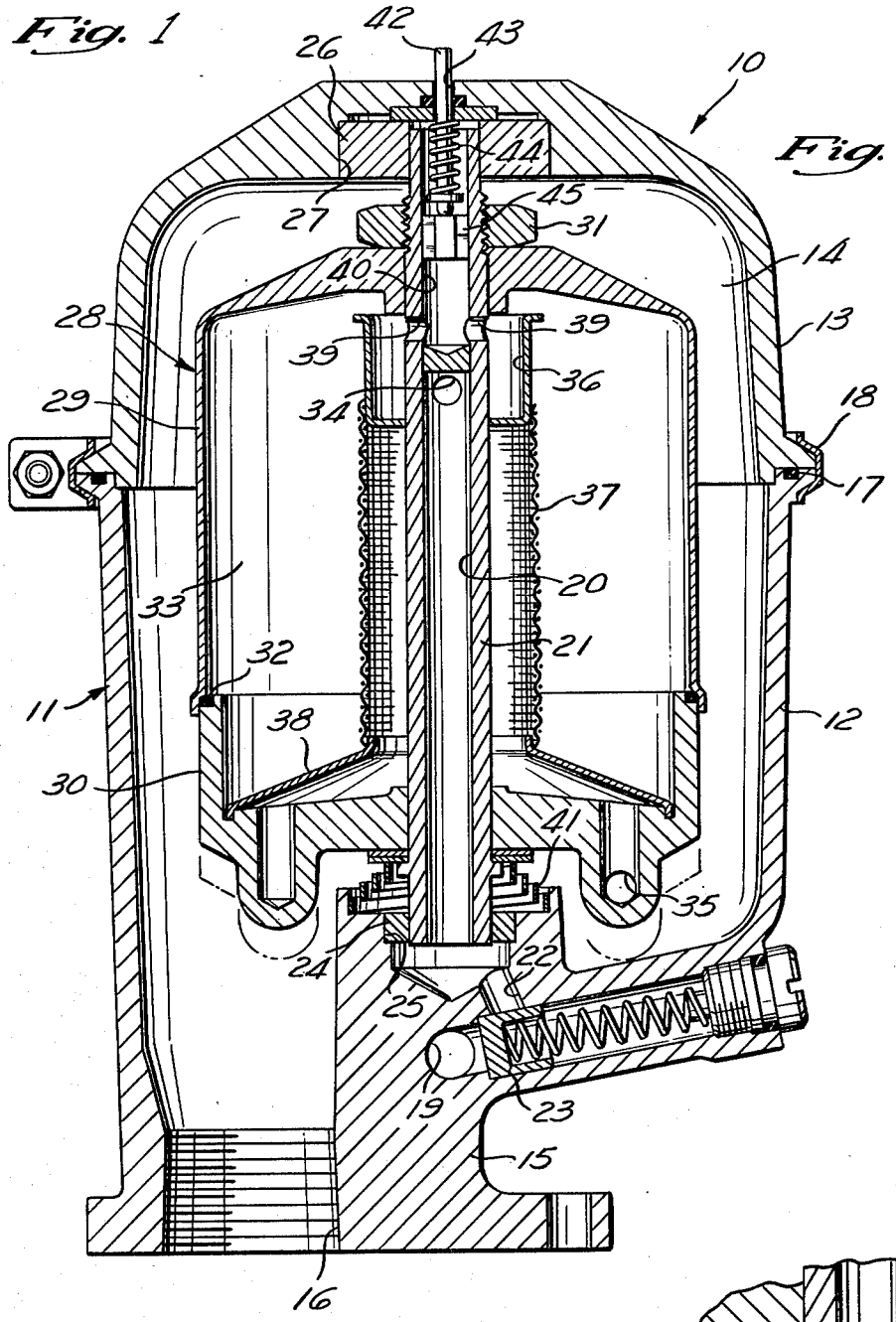
Fig. 2
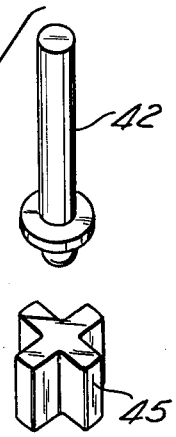
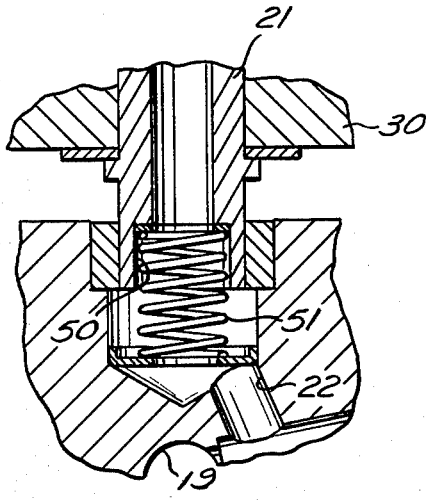
Fig. 3

CENTRIFUGAL FILTER WITH EXTERNAL SERVICE INDICATOR

BACKGROUND OF THE INVENTION

Conventional fluid filters, such as oil filters, are basically mechanical strainers which include a filter element having pores which trap and segregate dirt from the fluid. Since the flow through the filter is a function of the pore size, filter flow will decrease as the filter pack becomes clogged with dirt. Since the filtration system must remove dirt at the same rate at which it enters the oil, a clogged conventional pack cannot process enough oil to keep the dirt level of the oil at a satisfactory level. A further disadvantage of some mechanical strainer type filters is that they tend to remove oil additives. Furthermore, the additives may be depleted to some extent by acting upon trapped dirt in the filter and are rendered ineffective for their intended purpose on a working surface in the engine.

Prior art centrifugal filters have been proposed which do not act as mechanical strainers but, rather, remove contaminants from a fluid by centrifuging. For example, such a filter is shown in U.S. Pat. No. 3,432,091 granted to Beazley. In the Beazley patent, there is illustrated a hollow rotor which is rotatably mounted on a spindle. The spindle has an axial passageway which conducts oil into the interior of the rotor. Tangentially directed outlet ports are provided in the rotor so that the rotor is rotated upon issuance of the fluid therefrom. Solids, such as dirt, are centrifuged to the sidewalls of the rotor and the dirt may be later removed by disassembling the rotor and scraping the filter cake from the sidewalls.

Such centrifugal filters have oil inlets and outlets through the base of the filter, since access to the rotor for cleaning purposes is provided by removing a shroud cover and by then removing the rotor from the spindle. Such a maintenance operation is frequently not necessary, but the user of the filter has no way of knowing this until after the filter is disassembled.

SUMMARY OF THE INVENTION

This invention relates to a centrifugal separator which has an external indicator to provide information as to the condition of the filter bowl or rotor. More specifically, the invention pertains to a centrifugal filter having a shroud which defines a first chamber and a vertically extending spindle within the shroud having a hollow rotor mounted for rotation therewith. The rotor defines a second chamber for receiving contaminated fluids, such as oil, to be separated. There is provided an inlet port at one end of the spindle and passage means through the spindle to the second chamber. The rotor is rotated by tangential outlet ports and such rotation causes contaminants within the second chamber to migrate toward a sidewall of that chamber under the influence of centrifugal force.

The spindle, and therefore the rotor, are axially movable within the first chamber and the spindle is biased toward one end of the first chamber by a spring. There is also provided an indicator pin extending through the end of the shroud toward which the spindle is biased and adapted to follow movement of the spindle. Thus, as particulate matter accumulates in the second chamber, the weight increase of the rotor causes the rotor to settle at lower positions when at rest. The indicator pin is therefore drawn deeper and deeper into the rotor to give a visual indication of the degree to which the second chamber has become contaminated.

BRIEF DESCRIPTION OF THE DRAWING

FIG. 1 is a cross sectional view of a centrifugal filter according to this invention;

FIG. 2 is a perspective view of the indicator pin and its mounting spider; and

FIG. 3 is a fragmentary, cross sectional view illustrating an alternate mounting arrangement for the rotor spindle.

DETAILED DESCRIPTION OF THE INVENTION

Referring now to the drawing, there is illustrated a centrifugal separator 10 having a sealed shroud 11. The sealed shroud 11 includes a base 12 and a top cover 13. The interior of the shroud 11 constitutes a first chamber 14. The base 12 further includes a flanged foot structure 15 which defines an outlet port 16. The foot structure 15 is adapted to be connected to an engine or other mechanism to be lubricated by bolting the flanged foot structure 15 to a valve cover, an oil filler tube, the crankcase, or sideplates with suitable fittings. The cover 13 is sealed against the base 12 by an O-ring 17, and the cover 13 and the base 12 are clamped together by a V-shaped band 18. An inlet port 19 is bored into the base 15 and communicates with an axial passage 20 bored in a vertical spindle 21 by way of a passageway 22 in the base 12. Since the centrifugal filter is a bypass filter, an isolating valve 23 is provided between the inlet port 19 and the passageway 22, and is adapted to cut off flow to the filter if the supply of pressure drops below a predetermined level to assure maximum oil flow to the engine under startup and low idle speed conditions. The lower end of the spindle 21 is mounted in a bearing 24 which is press-fitted within a counterbore 25 in the base 12. The spindle 21 is rotatably and axially slidably mounted in the bearing 24. The other end of the spindle 21 is rotatably and axially slidably mounted in a bearing 26 which is press-fitted into a recess 27 in the cover 13.

Carried by the spindle 21 and fixed thereto by a key (not shown) is a rotor assembly 28 which consists of an upper body section 29 and a lower body section 30. The body sections 29 and 30 are clamped together by a nut 31 threaded onto the upper end of the spindle 21 and are sealed by a gasket 32.

Oil is fed into a second chamber 33 within the rotor assembly 28 through at least one passageway 34 and egresses through reaction nozzles 35 provided at the lower end of the rotor. In order to reach the reaction nozzles 35, the oil passes through a cup-shaped baffle 36 which tends to direct the contaminated oil out toward the sidewalls of the rotor assembly 28 to encourage the contaminants to be deposited on the sidewalls of the rotor assembly. To ensure that large particles will not clog the reaction nozzles, a screen 37 surrounds the spindle 21 and extends from the cup-shaped baffle 36 to a conical baffle 38. Since oil under pressure substantially fills the second chamber 33, the upper bearing 26 is lubricated by oil passing through inlet ports 39 in the spindle 21 and then through an axial passageway 40. Oil is expelled from the second chamber 33 through the tangentially mounted outlet ports 35 and, since those ports are oppositely directed, they cause the rotor assembly to rotate according to the principle of Hero's engine.

As the rotor assembly 28 rotates, suspended solids migrate to and are retained at the sidewalls of the rotor assembly with a force which is dependent upon the running oil pressure of the engine, which is typically between 50 and 80 psi for a diesel engine. The rotor speed usually exceeds 5000 rpm and the force on the dirt particles exceeds 1800 g's. In time, the dirt particle and sludge form a rubbery mass at the rotor sidewalls.

As has been previously noted, the spindle 21 is mounted for limited axial movement relative to the bearings 24 and 26. When the rotor assembly is uncontaminated, it is biased upwardly to its solid outline position by a conical coil spring 41. An indicator pin 42 extends through an aperture 43 at the top of the cover 14 and is biased by a coil spring 44 against a spider member 45 which is press-fitted into the passage 40. Thus, as the rotor assembly accumulates contaminants, its weight increase will cause the rotor assembly to approach the phantom outline position illustrated in FIG. 1. As the rotor assembly 28 approaches this position, the indicator pin 42 follows and its apparent length is shortened, thus giving a visual indication of the condition of the rotor. Of course, a reading should be made when the filter is at rest with the engine off, since there exists a hydraulic imbalance which tends to hydraulically shift the spindle 21 upwardly when the system is pressurized.

An alternate spindle biasing spring is illustrated in FIG. 3. In that figure, the lower end of the spindle 21 is provided with a counterbore 50 which receives a cylindrical coil spring 51 to bias the spindle 21 upwardly.

Although the preferred embodiment of this invention has been shown and described, it should be understood that various modifications and rearrangements of parts may be resorted to without departing from the scope of the invention as disclosed and claimed herein.

What is claimed is:

1. In a centrifugal separator for separating contaminants from contaminated fluids comprising shroud means defining a first chamber, a vertically extending spindle within said shroud means and having a hollow rotor mounted for rotation therewith, such hollow rotor defining a second chamber for receiving contaminated fluids to be separated, inlet port means at one end of said spindle, passage means through said spindle to said second chamber, means to rotate said rotor and thereby cause contaminants in contaminated fluids within said second chamber to migrate toward the sidewall of said second chamber under the influence of centrifugal force and to be separated from such contaminated fluids, said means to rotate said rotor comprising tangentially mounted outlet port means on said rotor in fluid communication with said second chamber to cause said rotor to rotate upon discharge of fluid from said second chamber to said first chamber, in combination therewith the improvement comprising means responsive to the accumulation of contaminants at said sidewall of said second chamber to indicate the degree to which said contaminants have collected on said sidewall, said spindle being axially movable within said shroud, biasing means to axially urge said spindle towards one end of the shroud, indicator means extending through said shroud and contacting said spindle, said indicator means being responsive to axial downward displacement of said spindle against the urging of said biasing means as contaminants accumulate in said rotor.

2. A centrifugal separator for separating contaminants from contaminated fluids comprising shroud means defining a first chamber, a vertically extending spindle within said shroud means and having a hollow rotor mounted for rotation therewith, said hollow rotor defining a second chamber for receiving contaminated fluids to be separated, inlet port means at one end of said spindle, passage means through said spindle to said second chamber, means to rotate said rotor comprising tangentially mounted outlet port means on said rotor in fluid communication with said second chamber to cause said rotor to rotate upon discharge of fluid from said second chamber to said first chamber, said spindle being axially movable within said shroud means and being biased toward one end of said shroud means by first biasing means, an indicator pin extending through said one end of said shroud means and being biased against one end of said spindle by second biasing means, whereby as contaminants collect on the sidewall of said second chamber the weight increase of the second chamber will cause the spindle to move downwardly and whereby said indicator pin will also move downwardly to permit a visual observation of the condition of the second chamber without dismantling the separator.

3. A centrifugal separator according to claim 2, wherein said first biasing means comprises a conical spring.

4. A centrifugal separator according to claim 2, wherein said first biasing means comprises a cylindrical spring.

* * * * *